United States Patent [19]

Kinkel et al.

[11] 4,154,029

[45] May 15, 1979

[54] STEEL CONCRETE CONTAINER AND A PROCESS FOR ERECTING THE SAME

[76] Inventors: Horst Kinkel; Hanspeter Harries, both of Richard Wagner Str. 15, 6078 Neu-Isenburg, Fed. Rep. of Germany

[21] Appl. No.: 845,428

[22] Filed: Oct. 25, 1977

[30] Foreign Application Priority Data

Oct. 30, 1976 [DE] Fed. Rep. of Germany ..... 2649936

[51] Int. Cl.[2] ..... F04B 1/32

[52] U.S. Cl. ..... 52/80; 52/223 R; 52/741; 264/228

[58] Field of Search ..... 52/80, 81, 83, 224, 52/223 R; 264/32, 228; 52/741

[56] References Cited

U.S. PATENT DOCUMENTS

| | | | |
|---|---|---|---|
| 2,558,580 | 6/1951 | Pomykala | 52/224 X |
| 3,153,303 | 10/1964 | Wheeler | 52/224 X |
| 3,427,777 | 2/1969 | Crowley | 52/80 X |
| 3,781,401 | 12/1973 | Courbon | 264/228 |

FOREIGN PATENT DOCUMENTS

| | | | |
|---|---|---|---|
| 218858 | 10/1958 | Australia | 52/82 |
| 222709 | 7/1959 | Australia | 52/223 R |
| 557869 | 5/1923 | France | 52/80 |
| 1444928 | 5/1966 | France | 52/80 |
| 767708 | 2/1957 | United Kingdom | 52/324 |
| 316827 | 6/1972 | U.S.S.R. | 52/82 |

*Primary Examiner*—Alfred C. Perham
*Attorney, Agent, or Firm*—Haight & Huard

[57] ABSTRACT

A steel concrete container with a roof formed as a suspended shell comprising sector-shaped precast, prestressed concrete elements and a reinforced concrete topping.

8 Claims, 12 Drawing Figures

STEEL CONCRETE CONTAINER AND A PROCESS FOR ERECTING THE SAME

BACKGROUND OF THE INVENTION

1. Field of the Invention

This invention refers to containers and more particularly to a container of steel concrete with a roof of sectorshaped prefabricated steel concrete components. Further the invention refers to a process for preparing such a container.

2. Description of the Prior Art

Large-scale containers of steel concrete are required for various purposes, particularly for storing drinking water, water for fire fighting, oil, fuel and other liquids as well as for the treatment of waste water and for storing granular material. Usually such containers are erected as a monolithic construction. In the case of small-scale containers, the usual flat roof may be provided. In the case of large scale containers, this mode of construction is not suitable.

So far in the case of large-scale containers, rooves with girders have been used. In both cases a plurality of supporting pillars have been necessary which must be distributed inside the container and which must be provided with foundations in the bottom plate. This mode of construction requires a large amount of concrete and steel and excessive manual labor. The erection of such a roof requires a scaffolding and form. The costs for the scaffolding and the form constitute a considerable part of the total costs for erecting the container. Further the container must have a cylindrical shape due to the high pressures. This geometry does not permit the erection of the roof in a series of individual sections and to, in this manner, lower the costs for the scaffolding and form.

Further it was attempted to lower the costs for the container roof by erecting a domed roof by assembled pre-cast, sectorshaped structural units. However, with this mode of construction, the container wall is subjected to a high tensile strain in the circumferential direction so that the costs for the reinforced container wall are increased. It has further been suggested to erect the container roof as a suspended roof with steel ropes on which concrete plates are layed. In such a roof the loads are carried merely by the ropes and therefore the roof is not very stable. Further the steel cables show a high thermal expansion so that the sealing of the joints is difficult.

Therefore a container has been suggested whereby merely a central support is provided and whereby the roof consists of beam-type, sector-shaped, precast steel concrete elements, which are supported by the container wall and the central support. Such a construction offers substantial economic advantages due to the avoidance of the costs for the scaffolding and form. It is however not suitable for erecting largescale containers since large amounts of material would be necessary for preparing the beam-type, precast components which are substantially only subject to bending strain.

BRIEF SUMMARY AND OBJECTIVES OF THE INVENTION

Therefore it is an object of the present invention to provide an economical container of steel concrete, particularly for water, oil or the like.

Further it is the object of the invention to provide a container of steel concrete which can be erected in an economical manner by assembling precast elements and which nevertheless has the stability advantages of a monolithic container.

Further it is the object of the invention to provide a process for erecting such a container.

According to the present invention, a container of steel concrete, particularly for water, oil or the like, is provided which comprises a bottom plate, a substantially cylindrical container wall and a roof comprising sector-shaped precast steel concrete elements anchored on the container wall, which is characterized by a suspended shell roof consisting of sector-shaped, precast, prestressed concrete elements and a reinforced concrete topping.

Such a container offers a number of substantial advantages. Girders and a plurality of steel concrete supports as well as foundations therefor can be eliminated. The container roof may be erected without scaffolding and form. All elements of precast, prestressed concrete have the same shape and can be easily prepared in the factory. After the simple assembly of the precast, prestressed concrete elements, they serve as a form for applying the reinforced concrete topping. Thereby a bonding occurs between the container wall, the prestressed, precast concrete elements and the concrete topping, whereby a monolithic structure is obtained. The thus formed suspension roof shows all of the advantages of the conventional monolithic construction, particularly a high stability and an absolute tightness. Further the completed suspension roof may be substantially jointless.

It is preferable to suspend the container roof at a circular slab in the center of the container. This slab may be supported by a single support or by a plurality of supports arranged on a circle. For erecting containers with extremely large diameters, it is possible to provide one or several concentric, intermediate supports in the form of support walls or in the form of a ring beam held by support pillars. In this case the suspension roof is composed of concentrical ring-shped sections. The bonding between the concrete topping, the precast, prestressed concrete elements and the container wall and so forth for forming an integral monolithic structure may be aided by the projecting ends of the reinforcing steel. If the central support or the intermediate supports are sufficiently high, any rain water may easily run off inspite of the sag. Further the central support may be eliminated. In this case, an auxiliary central support is used for assembly purposes. If the roof sags to such an extent that a depression is formed, a filling with light concrete may be provided.

The process of the present invention for erecting the container is characterized by the steps of erecting the bottom plate, the container wall and optionally the central support and the intermediate walls, followed by the step of assembling the precast elements of prestressed concrete and finally by the step of pouring the concrete topping of locally prepared concrete onto the precast, prestressed concrete elements serving as form.

In a preferred embodiment, the precast, prestressed concrete elements are cast in a plane tension bed. After the cast concrete has set or solidified, the elements are bent under plastic deformation so as to obtain a curvature which corresponds essentially to the curvature of the suspended roof. This is achieved best by a plurality of supports of predetermined height arranged in a predetermined spaced relationship to each other on which the freshly set or solidified concrete elements are resting under their own weight for a certain period of time. Thereafter the precast, prestressed concrete elements substantially maintain their deformation state. However, during transort to the construction site, they may lay flat since they have a sufficient softness so as to be bendable.

The invention will be further described by way of specific embodiments shown in the accompanying drawings.

DETAILED DESCRIPTION OF THE INVENTION

Figure 1:
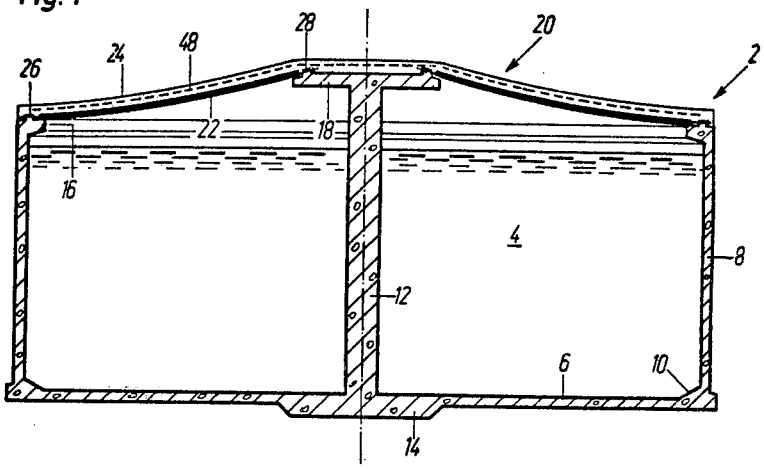
FIG. 1 shows a cross-section of a first embodiment of the container according to the invention.
Figure 2:
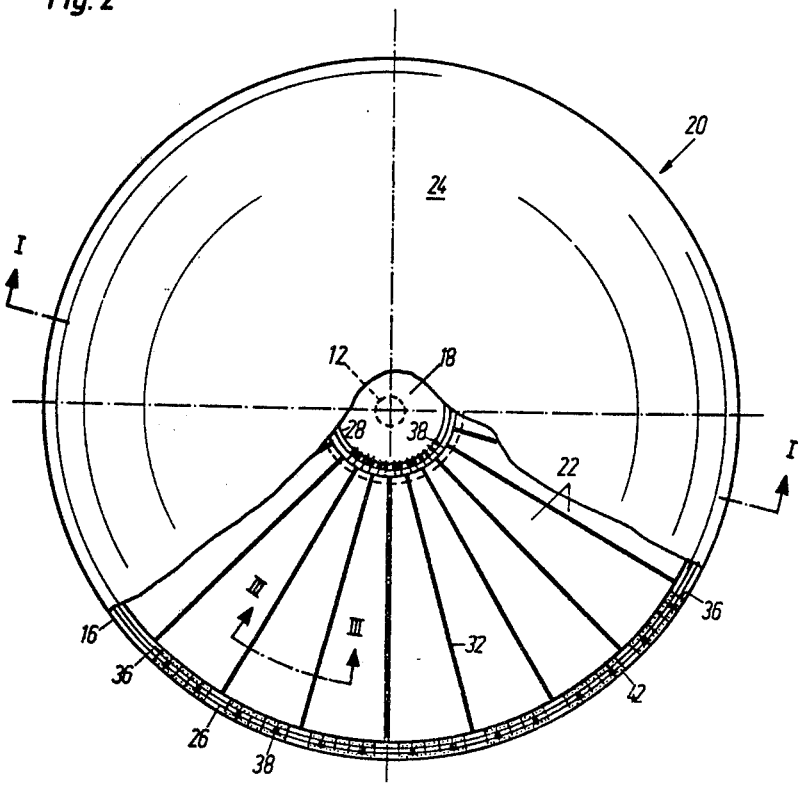
FIG. 2 shows an plan view of the container according to FIG. 1, the concrete topping being partly removed.
Figure 3:
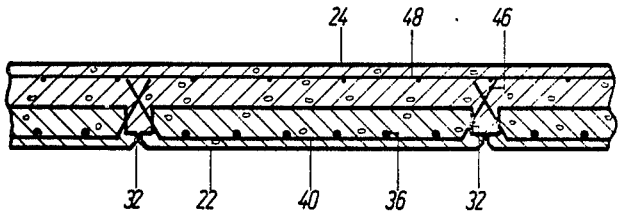
FIG. 3 shows a cross-section along the line III—III of FIG. 2.
Figure 4:
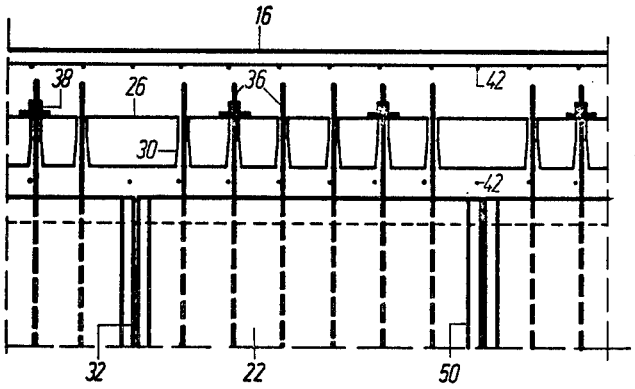
FIG. 4 shows a partial plan view of the peripheral area of the container roof in the assembly stage without concrete topping.

A first embodiment of the container according to the present invention will now be described with reference to FIGS. 1 to 5. The container 2 is filled according to FIG. 2 with water 4 and comprises a bottom plate 6, a container wall 8 and a central support column 12, as well as a suspended roof 20. The circular bottom plate 6 consists of reinforced concrete and comprises in the area below the container wall 8 an annular foundation 10 for distributing the load. A further foundation 14 is provided below the central support column 12. Outside the foundations 10 and 14 the bottom plate comprises merely a reinforcement for constructional purposes. The central support column 12 carries on its upper end a circular slab 18. The container wall 8 has a substantially cylindrical configuration and comprises at its upper end a reinforcing compression ring 16. The bottom plate 6, the container wall 8 and the central support column 12 consists of steel-reinforced concrete and they are preferrably erected from concrete prepared at the site. However, it is also possible to erect these parts by assembling precast elements. The container wall may, in this case, consist of individual ring segments which are braced to each other. The water filling 4 subjects the cylindrial container wall 8 to a circumferential tension. The container wall comprises an annular reinforcement which may optionally be prestressed and it may additionally comprise a vertical reinforcement which also may optionally be prestressed. Also the bottom plate may comprise a reinforcement prestressed in the annular direction.

The suspended roof 20 of the container constitutes an integral shell. It consists of sector-shaped precast, prestressed concrete elements 22 and of a concrete topping 24. The precast, prestressed concrete elements 22 have all the same configuration. They contain tension wires 36, which extend substantially in the radial direction of the container and approximately centrally in the precast elements. The precast, prestressed concrete elements 22 are anchored at the circular slab 18 and the container wall 8 by means of tensions heads 38 (FIG. 4), and each element extends over the distance between said slab and said wall. For this purpose the compression ring 16 and the circular slab 18 comprise each an anchoring ring 26 or 28, respectively with a plurality of slots 30. The projecting ends of the tension wires 36 are inserted into the slots 30. All of the tension wires 36 or a part thereof are braced with tension heads 38 of usual construction against the reinforcing anchoring rings 26 or 28, respectively. The vertical limp reinforcing steel wires of the reinforcement of the container wall 8 project upward into the concrete topping and form connecting elements 42, so that a secure connection between the concrete topping 24 and the container 8 is insured. Additionally to the tension wires 36 the precast, prestressed elements 22 contain a limp reinforcement 40, the ends 46 of which also extend into the contrete topping. The concrete topping 24 is made from concrete prepared at the site and contains a limp reinforcement 48. It is firmly connected with the container wall 8 and with the precast, prestressed elements 22 through the projecting ends 42 and 46 of the reinforcement and through the projecting ends of the tension wires 36. Further the concrete topping 24 may be firmly connected with the circular slab 18 by projecting ends of the reinforcing wire or steel rods.

The process for erecting the container 2 shall now be described. First the bottom plate 6, the foundations 10, 14 and the container wall 8 as well as the compression ring 16 and the anchoring ring 26 as well as the central support column 12 and the circular slab 18 and the anchoring 28 are erected from concrete prepared at the site in the usual manner by means of a form. The slots of the anchoring rings 26, 28 are provided at the proper positions. Further, care must be taken that projecting ends 42 of the reinforcing steel are provided. If necessary a prestressed reinforcement may also be provided. Therefore, the prestressed, precast elements 22 which have been prepared in a factory are lifted into the proper positions by a crane whereby the ends of the tension wires 36 are inserted into the slots 30. Thereafter the tension heads 38 are mounted, whereupon the precast, prestressed elements are released from the craine. After all precast, prestressed elements 22 have been anchored, the exact height is adjusted by an adjustment of the tension heads 38 by means of the usual tools so that the precast, prestressed elements 22 are in alignment with each other over their entire longitudinal extension. The manufacture of the precast, prestressed elements 22 will be discussed in detail below. Between the prestressed, precast elements 22 a joint or interstice 32 remains which may be filled later on with concrete prepared at the site. Relative to their length the precast, prestressed concrete elements 22 have a bending softness and they carry the load almost exclusively by membrane effect. However, it is possible to brace the precast, prestressed concrete elements 22, which are prestressed in the radial direction, also in the circumferential direction to each other so that a shell which is prestressed in the circumferential direction is obtained.

The central support column 12 extends above the container wall 8 by such an amount that inspite of the sag of the precast, prestressed concrete elements 22, any rain water may run off. After the precast, prestressed elements 22 have been suspended and adjusted, the limp reinforcement 48 is applied, whereafter the concrete topping 24 is poured by using locally prepared concrete. This results in a firm connection between the concrete topping and the container wall 8, the precast elements 22 and the circular slab 18 via the extending ends of the reinforcement which are embedded within the concrete topping.

Prior to the setting of the concrete topping the roof carries all loads by rope effect. After the setting of the concrete topping, annular forces arise which lessen the cable forces for all load conditions including the insulation, a protective concrete and traffic load. Due to the suspension effect, tension forces arise in the central circular slab 18 which are easily accommodated therein while compression forces arise at the periphery in the compression ring 16. These compression forces are desirable since they generate a prestress in the container wall 8. The prestress force of the prestressed, precast elements 22 is chosen such that the tension forces arising from the suspension effect are at all times exceeded. The central support column 12 carries almost the entire roof load. It is dimensioned such that it may withstand the unilateral pull arising in the course of the assembly. The assembly of the precast elements is effected preferrably symetrically. The compression ring 16 is dimensioned for receiving the compression forces arising from the suspension effect and for circumferentially supporting the moments arising during the assembly.

The described mode of construction of the container roof combines the advantages of the assembly construction mode with the advantages of the monolithic construction. In the roof construction scaffoldings and forms are completely eliminated which leads to substantial economical advantages. The mounted precast, prestressed concrete elements function as a mold for the subsequent pouring of the concrete topping. After the setting of the concrete topping it is firmly connected with the container wall and the precast elements so that the final container roof has all the advantages of a monolithically erected roof. It is completely water tight so that no rain water may penetrate the roof and enter the container.

After the erection of the container, earth may be filled up or heaped up at the outside of the container wall 8 so that pressure is applied to the container wall from the outside to counteract the pressure exerted by the water filling, which increases in the downward direction. Further it is possible to erect the container under ground and to cover the container roof with earth. The thermoexpansion of the container roof 20 generates forces within the container wall 8 which are conteracted by the cable forces of the roof, which generate in the pressure ring 16 a prestress.

Figure 5:
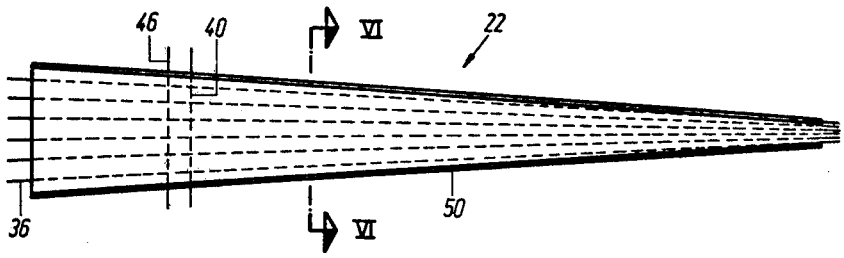
FIG. 5 shows an plan view of the precast, prestressed concrete elements for the container according to the invention.
Figure 6:
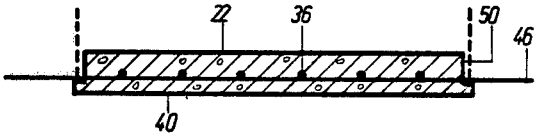
FIG. 6 shows a cross-section along the line VI—VI of FIG. 5.

FIGS. 5 and 6 show further embodiments of the prestressed, precast concrete elements. FIG. 5 shows an elevational view of a precast element 22. The tension wires 36 are indicated by a chain line. The ends of the tension wires 36 project beyond the concrete element. Limp reinforcement bars 40 extending in the traverse direction are distributed over the entire length of the precast, prestressed concrete elements 22. FIG. 5 shows only some of these reinforcements. Their ends extend beyond the concrete elements as connecting elements 46 which can be bent upward. A recess 50 extends along both longitudinal edges of the concrete element 22. In the terminal areas of the concrete elements 22, additional limp reinforcing steel bars may provided.

Figure 7:
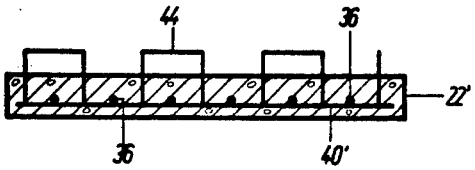
FIG. 7 shows a cross-section of a modified embodiment of the precast, prestressed concrete elements.

FIG. 7 shows a cross-section of a modified embodiment of the precast, prestressed concrete elements 22' which differs from the element according to FIGS. 5 and 6 by a plurality of connecting elements 44 distributed over the entire surface of the precast, prestressed concrete element 22'. Therefore the limp reinforcement bars 40' must not extend beyond the edge and it is also not necessary to provide a recess along bottom longitudinal edges for bending the reinforcing bars upward. Of course in the embodiment of FIGS. 5 and 6 connecting elements may also be distributed over the entire surface of the concrete element additionally to the protruding ends of the limp reinforcement rods 40. The precast, prestressed elements may have longitudinal ribs for increasing the mechanical strength.

Figure 8:
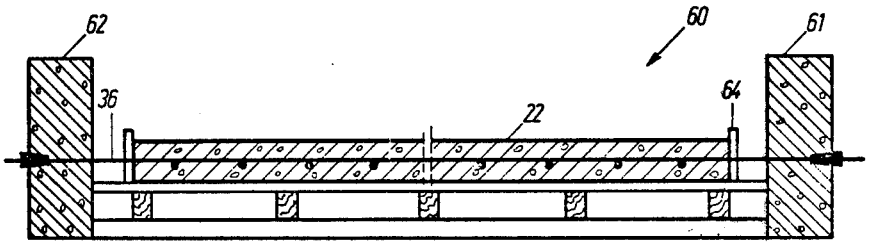
FIG. 8 shows a schematic cross-sectional view of the tension bed for preparing the precast, prestressed concrete elements according to FIG. 5.

The manufacture of the precast, prestressed concrete elements shall now be discussed with reference to FIGS. 8 and 9. FIG. 8 shows a tension bed 60 for casting the precast, prestressed elements 22. The tension wires 36 are tensioned between a block 61 and a tensioning device 62. The tension wires may have a diameter of about 1 cm.; per 10 Mp about 4 to 20 tension wires are provided. Thereafter the concrete element 22 is cast into a form 64. The precast, prestressed elements can be cast in a plane shape inspite of the rather severe curvature in the assembly state. This allows a considerable reduction of the manufacturing costs. After the concrete has set, the tension applied by the tensioning device is released so that the pre-stress is applied to the concrete.

Figure 9:
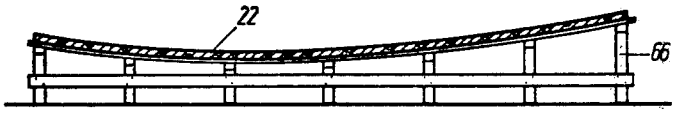
FIG. 9 shows a precast, prestressed concrete element resting in a curved state.

Thereafter the fresh and still soft elements are stored in a curved state according to FIG. 9. For this purpose support elements 66 of predetermined height are arranged with predetermined spacing. During this storage process the fresh concrete undergoes a plastic deformation. The setting of the concrete within the tension bed requires about 1 to 3 days. The duration of the storage for effecting the plastic deformation amounts to about at least four weeks. The precast, prestressed elements obtain their curvature due to plastic shortening by a creeping effect in the compression zone. After the storage time the hardened precast, prestressed elements have a permanent curvature. This curvature corresponds approximately to the curvature in the assembly state. However, the precast, prestressed elements have a bending softness so that they may be layed flat during transport. It has surprisingly been found that with the above described economical manufacturing process, precast, prestressed elements may be obtained which will not show cracks in the mounted state in case of a sag of 40 to 70 cm. Of course it is also possible to cast the concrete elements in a form having the final curvature. For this purpose a more expensive tension bed is required and the tension wires must be deflected by deflection elements.

Figure 10:
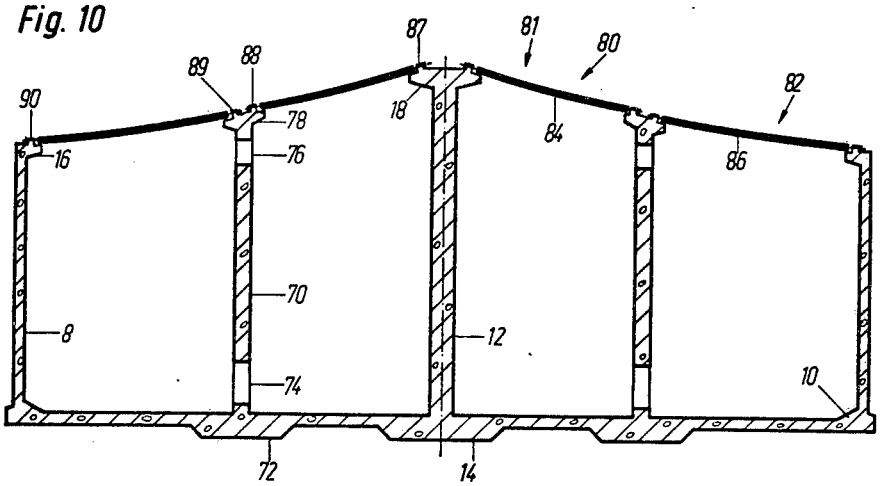
FIG. 10 shows a cross-section of a second embodiment of the container according to the present invention in the assembly state without concrete topping.

The precast, prestressed elements may have a length of from 5 to 25 m and preferably of from 10 to 20 m. Concrete elements of this length hava a sufficient bending softness if the thickness lies in the range of from 6 to 15 cm and preferably in the range of from 8 to 10 cm. Such concrete elements will show a sag of about 40 to 90 cm. With the embodiment shown in FIGS. 1 to 4, containers with a diameter of about 40 to 50 m may be erected. Thereafore the above described first embodiment of the container is limited to the relatively small containers. With reference to FIG. 10, a second embodiment of the container shall now be described which allows substantially larger diameters. Corresponding components in FIGS. 10 and 2 carry the same reference numerals.

The container according to the second embodiment comprises an intermediate support wall 70 concentrically to the container wall 8. Below this support wall 70, an annular reinforcing foundation 72 is provided in the bottom plate. Lower and upper openings 74 or 76, respectively are provided in the intermediate support wall 70, which serve for a fluid connection of both rooms. The intermediate support wall 70 is higher than the container wall 8, but lower than the central support column 12. On the upper rim the intermediate support wall 70 comprises a reinforcing ring 78.

The container roof 80 consists again of precast elements and of a concrete topping and it is subdivided into two concentrical areas, namely an inner area 81 and an outer area 82. All precast, prestressed concrete elements 84 of the innter area 81 have the same configuration and all precast, prestressed concrete elements 86 of the outer area 82 have also the same configuration. The precast, prestressed concrete elements 84 of the inside elements 81 are suspended at anchoring rings 87, 88 which are cast on the circular slab 18 of the central support column 12 and on the reinforcing ring 78 of the intermediate wall 70, respectively. The precast, prestressed concrete elements 86 of the outer area 82 are suspended at anchoring rings 89, 90, which are cast onto the reinforcing ring 78 and the compression ring 60, respectively. Each of the concrete elements extends over the entire distance between the points at which it is anchored. The central support column carries a part of the load of the inside area 81 of the roof while the other part is supported by the intermediate support wall 70. With respect to this load the reinforcing ring 78 of the intermediate support wall 70 acts as a tension ring. If the height of the intermediate support wall 70 exceeds the container wall 8 by a sufficient amount and if the central support column 12 exceeds the intermediate support 70 by a sufficient amount, any rain water may run off smoothly. In such a case, the central support column carries almost the entire load of the inside area 81 of the roof while the intermediate support wall 70 carries almost the entire load of the outside area 82 of the roof. In case of a lesser height of the intermediate support 70 and of the central support column 12, the roof load is distributed more evenly so that the compression stress exerted by the inside area 81 of the roof onto the reinforcing rings 78 counteracts the tension stress exerted by the outside area 82 of the roof onto the reinforcing ring 78. It may be advantageous to apply a circumferential pre-stress to the intermediate support wall and particularly to the reinforcing ring. Also in this embodiment, the reinforcement of the container wall 8, the central support column 12 and the intermediate wall 70 extends into the concrete topping. Again the ends of the reinforcement of the prestressed, precast elements 84 and 86 extend into the concrete topping so that a firm connection between the concrete topping and all precast, prestressed concrete elements as well as the container wall 8, the intermediate support wall 70 and the central support column 12 is obtained.

With such a container construction diameters of up to 100 m and preferably up to 80 m may be erected. Of course it is possible to provide additional concentric intermediate support walls so that with this principle of construction containers of very large size may be erected.

Figure 11:
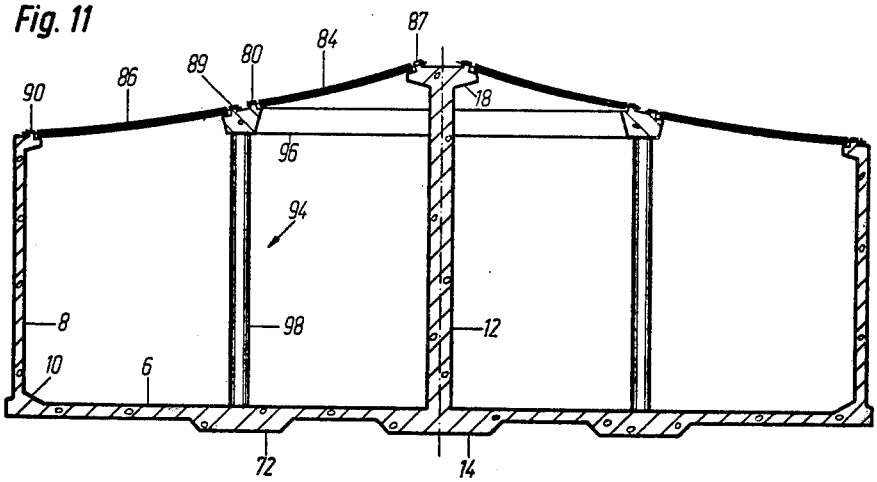
FIG. 11 shows a cross-section of a third embodiment of the present invention in the assembly state without concrete topping and FIG. 12 shows a cross-section of a fourth embodiment of the container according to the present invention in the assembly state without concrete topping.

In accordance with FIG. 11, a ring-shaped support wall 94 may consist of an annular beam 96 and circularly arranged individual supports 98. In further embodiments, the circular slab may be enlarged and supported by a plurality of circularly arranged individual supports.

Figure 12:
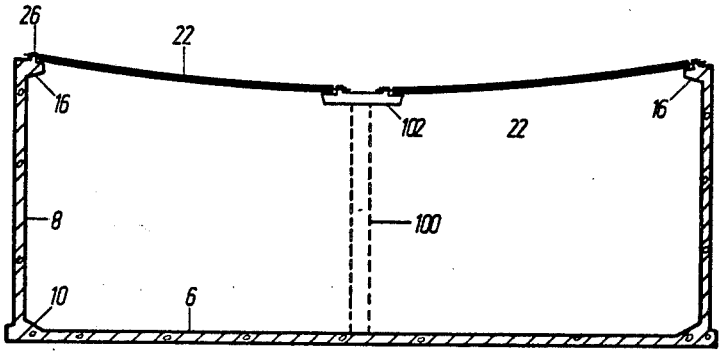

In the above-described embodiments a steel concrete central support has always been provided. However, it is also possible to erect a container without such a central support. Such an embodiment is shown in FIG. 12. The same components carry again the same reference numerals. For assembly purposes, an auxiliary central support 100 is erected which supports a central steel concrete anchoring part 102 in a predetermined height. The precast, prestressed concrete elements 22 are anchored at an anchoring ring 104 cast onto the compression ring 16. In the center of the roof they are connected with the central support part 102. Preferably the prestresse, precast concrete elements 22 may be braced in the centre with the part 102. After the assembly of the precast elements, the concrete topping is poured whereby again a firm connection between the concrete topping, the container wall 8, the precast element 22 and the central supporing part 102 is provided by protruding connection elements. After the concrete topping has set, the auxiliary central support is removed. With this embodiment the costs for erecting the central support and the foundation thereof are eliminated. The roof load is carried exclusively by the container wall 8 which must be therefore provided with a sufficiently strong compression ring 16. The indentation of the roof may be filled with a light concrete composite (gas concrete, pore concrete, styrofoam concrete, insulating concrete composition or the like) in order to ensure that the rain water will run off. Such a filling of the sag of the roof may also be provided in the case of the embodiments of FIGS. 2, 10 11. If the central support or the central support and the intermediate support wall, respectively, are not sufficiently high. It is also possible to combine the embodiment of FIG. 2 with the embodiments of FIG. 10 or 11. In this case the substantial compression stress of the reinforcing ring 78 due to the indented inside area of the roof counteracts the tension stress applied by the outside area of the roof onto the reinforcing ring 78. Usually the concrete topping will cover the entire container roof. Howevrr, the topping may be limited to the area of the joints and the anchorings.

Obviously numerous variations and modifications may be made without departing from the present invention. Accordingly it should be clearly understood that the forms of the present invention described above and shown in the accompanying drawings are illustrative only and are not intended to limit the scope of the present invention.

What is claimed is:

1. A monlithic steel concrete container comprising:
(a) a steel concrete bottom plate;
(b) a substantially cylindrical steel concrete container wall having an upper rim;
(c) a central steel concrete support having an upper circular plate; and
(d) a suspending steel concrete roof comprising:
(i) a plurality of radially oriented, sagging, precast, radially prestressed, sector-shaped steel concrete elements, each of said elements containing steel reinforcement means with first and second protruding ends, said first end being anchored at said upper rim of said container wall and said second end being anchored at said circular plate of said central support, each of said concrete elements extending at least over the distance between said upper rim and said circular plate; and
(ii) a reinforced concrete topping, monolithically united with said upper rim of said container wall, said circular plate of said central support and said plurality of sector-shaped elements, said protruding ends of said steel reinforcement means extending into the concrete topping.

2. A monolithic steel concrete container as set forth in claim 1, wherein said precast, radically prestressed, sector-shaped steel concrete elements are anchored by means of tension heads resting against anchoring rings.

3. A monolithic steel concrete container as set forth in claim 1, wherein concave areas of said suspended roof are filled with a light concrete composition.

4. A monolithic steel concrete container comprising:
(a) a steel concrete bottom plate;
(b) a substantially cylindrical steel concrete container wall having an upper rim; and
(c) a suspended steel concrete roof comprising:
(i) a plurality of radially oriented, sagging, precast, radially prestressed, sector-shaped steel concrete elements, each of said elements containing steel reinforcement means with first and second protruding ends, said first end being anchored at said upper rim of said container wall and said second end being anchored at a suspended central circular steel concrete plate, each of said concrete elements extending at least over the distance between said upper rim and said circular plate; and
(ii) a reinforced concrete topping, monolithically united with said rim of said container wall, said sector-shaped elements and said circular plate, said protruding ends of said steel reinforcement means extending into said concrete topping.

5. A monolithic steel concrete container comprising:
(a) a steel concrete bottom plate;
(b) a substantially cylindrical outer steel concrete container wall having an upper rim;
(c) a central steel concrete support having an upper circular plate;
(d) at least one concentrical intermediate steel concrete wall having an upper rim; and
(e) a suspended steel concrete roof comprising:
(i) an outer and at least one inner concentrical group of a plurality of radially oriented, sagging, sector-shaped, precast, radially prestressed steel concrete elements, each concrete element containing steel reinforcement means with first and second protruding ends, each concrete element of said outer group of elements being anchored with said first end at said upper rim of said outer wall and with said second end at said upper rim of said intermediate wall, each concrete element of said outer group extending at least over the distance between said upper rims, each concrete element of said at least one inner group of elements being anchored with said first end at said upper rim of said intermediate wall and with said second end at an upper rim of a further intermediate wall or at said circular plate of said central support, respectively, each concrete element of each of ssid at least one inner group extending at least over the distance between said upper rims, or an upper rim and said circular plate, respectively; and
(ii) a reinforced concrete topping, monolithically united with said upper rims of said outer wall and said intermediate walls, with said circular plate and with said sector-shaped elements, said protruding ends of said steel reinforcement means extending into said concrete topping.

6. A process for erecting a monolithic steel concrete container comprising the following steps:
(a) erecting a steel concrete bottom plate;
(b) erecting a substantially cyclindrical steel concrete container wall having an upper rim;
(c) erecting a central steel concrete support having an upper circular plate;
(d) suspending a plurality of sagging, radially oriented, precast, radially prestressed sector-shaped steel concrete elements, each of said elements containing steel reinforcement means with first and second protruding ends, by anchoring each of said elements with said first end at said upper rim and said second end at said circular plate, said protruding ends extending over said rim and said plate; and
(e) pouring a concrete topping of locally prepared concrete onto said rim of said container wall, said circular plate of said central support and said sector-shaped elements so that said ends of said steel reinforcement means are embedded within said concrete topping.

7. A process as set forth in claim 6 further including the step of forming said sector-shaped concrete elements by pouring concrete into a plane tension bed and by bending the freshly set elements under their dead weight so as to obtain a configuration corresponding to their final curvature in the suspended state.

8. A process as set forth in claim 6, wherein said anchoring of the precast, prestressed sector-shaped concrete elements is accomplished by means of tension heads which are adjusted so as to obtain an alignment of said elements over their entire length.

* * * * *